United States Patent [19]

Rohrbach

[11] Patent Number: 4,515,085

[45] Date of Patent: May 7, 1985

[54] SPEED CONTROL APPARATUS

[75] Inventor: Peter H. Rohrbach, Bath, Pa.

[73] Assignee: SI Handling Systems, Inc., Easton, Pa.

[21] Appl. No.: 514,123

[22] Filed: Jul. 15, 1983

[51] Int. Cl.[3] ..... B61K 7/02

[52] U.S. Cl. ..... 104/250; 104/166; 104/252; 74/568 R

[58] Field of Search ..... 104/165, 166, 249, 250, 104/252; 74/568 R

[56] References Cited

U.S. PATENT DOCUMENTS 3,903,810 9/1975 Jones ..... 104/166
4,059,053 11/1977 Jones ..... 104/35
4,348,961 9/1982 Rohrbach ..... 104/252
4,428,298 1/1984 Gutekunst et al. ..... 104/166

FOREIGN PATENT DOCUMENTS 2223533 11/1973 Fed. Rep. of Germany ..... 104/252

*Primary Examiner*—Randolph A. Reese
*Attorney, Agent, or Firm*—Seidel, Gonda, Goldhammer

[57] ABSTRACT

Apparatus is disclosed for controlling the angular position of a drive wheel on a driverless vehicle. The apparatus includes a speed control device movable between two positions and having a lost-motion coupling to a shock absorber so that the device moves rapidly toward the second position for part of its movement and then moves slowly for the remainder of its movement.

13 Claims, 7 Drawing Figures

SPEED CONTROL APPARATUS

BACKGROUND OF THE INVENTION

Speed control apparatus of the general type involved herein is known to those skilled in the art. For example, see U.S. Pat. Nos. 3,903,810; 4,059,053; and 4,348,961.

The apparatus of the general type involved herein controls the angular position of a drive wheel on a driverless vehicle. As is well known to those skilled in the art, the angular position of the drive wheel controls the speed of the vehicle. The speed control devices disclosed in said patents move between a deceleration position and an acceleration position at a uniform speed.

The present invention is directed to recognition that it would be desirable to have the control device move rapidly during an initial portion of its movement and then move slowly for the remainder of its movement. As a result thereof, the driverless vehicle will move quickly from a stop position to a position corresponding to an intermediate speed and thereafter will accelerate in a controlled manner.

SUMMARY OF THE INVENTION

The present invention is directed to apparatus for controlling the annular position of a drive wheel on a driverless vehicle. The apparatus includes a speed control device supported for pivotable movement between a first position wherein the device is adapted to contact a drive wheel and cause deceleration and a second position wherein the device is adapted to contact a drive wheel and cause acceleration. A motor means is provided for moving said device between said positions. A means is coupled to the device with a lost-motion connection or its equivalent so that said device moves rapidly toward said second position for the initial portion of its movement and then thereafter moves slowly for the remainder of its movement.

Various objects ad advantages will be set forth hereinafter.

For the purpose of illustrating the invention, there is shown in the drawings a form which is presently preferred; it being understood, however, that this invention is not limited to the precise arrangements and instrumentalities shown.

DETAILED DESCRIPTION

Figure 1:
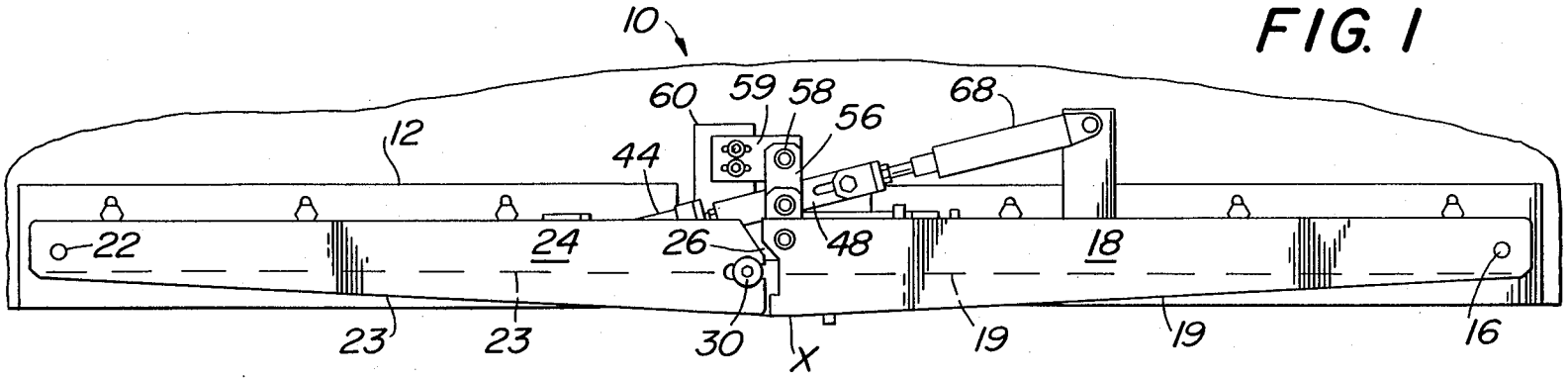
FIG. 1 is a top plan view of apparatus in accordance with the present invention.

Referring to the drawing in detail, wherein like numerals indicate like elements, there is shown in FIG. 1 apparatus in accordance with the present invention designated generally as 10. The apparatus 10 is adapted to be mounted along side of or between the tracks of a driverless vehicle system. The apparatus 10 is adapted to contact a cam follower or equivalent device which controls the angular position of a drive wheel on a driverless vehicle for controlling the speed of the driverless vehicle as it moves along the tracks. The purpose for controlling the speed of the driverless vehicle is to facilitate stopping the vehicle at predetermined locations for loading, unloading, for working on a part supported by the driverless vehicle, etc.

The apparatus 10 includes a base plate 12. As shown more clearly in FIG. 2, at one end of the base plate 12 there is provided a bearing 14 for a vertically disposed pivot pin 16. A speed control device 18 has one end pivoted to pin 16. Device 18 is preferably in the form of a flat plate which is above and parallel to the base plate 12. A surface on device 18, such as side edge 19, is adapted for contact with a cam follower or equivalent device associated with the drive wheel of a driverless vehicle. Depending upon the angular position of surface 19, the driverless vehicle will decelerate or move past apparatus 10 without stopping.

Figure 2:
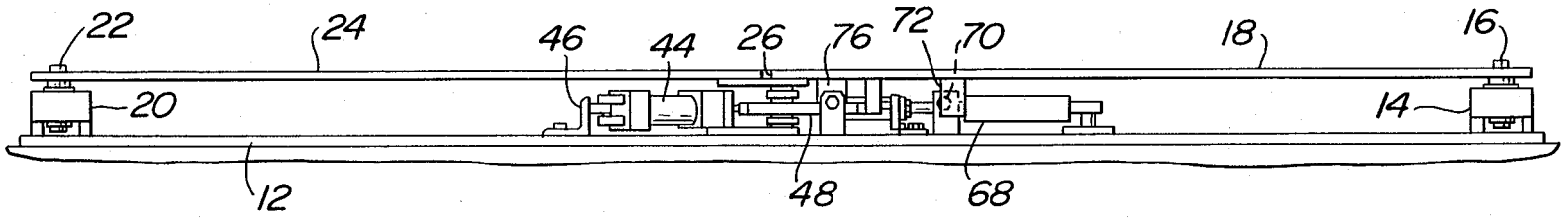
FIG. 2 is an elevation veiw of the apparatus shown in FIG. 1.

As shown more clearly in FIG. 2, there is provided a bearing 20 at the other end of the base plate 12. Bearing 20 supports a pivot pin 22. A second speed control device 24 is provided and has one end pivoted to pin 22. Device 24 is of the same elevation as device 18 as shown in FIG. 2. Device 24 has an acceleration surface 23. A gap 26 is provided between the juxtaposed ends of the devices 18 and 24. See FIG. 3.

A plate 28 is fixedly secured to the bottom surface of device 18 and overlaps the gap 26. See FIGS. 3 and 4. A block 30 is supported by a pin on the plate 28. Block 30 is disposed in a longitudinally extending slot 32 on the end of device 24 adjacent the gap 26. Block 30 has surface contact with slot 32 but could be a roller if desired. Thus, as device 18 pivots in a clockwise direction in FIG. 1 about pin 16, device 24 will pivot in a counter clockwise direction about pin 22 in FIG. 1, and vice versa.

Figure 4:
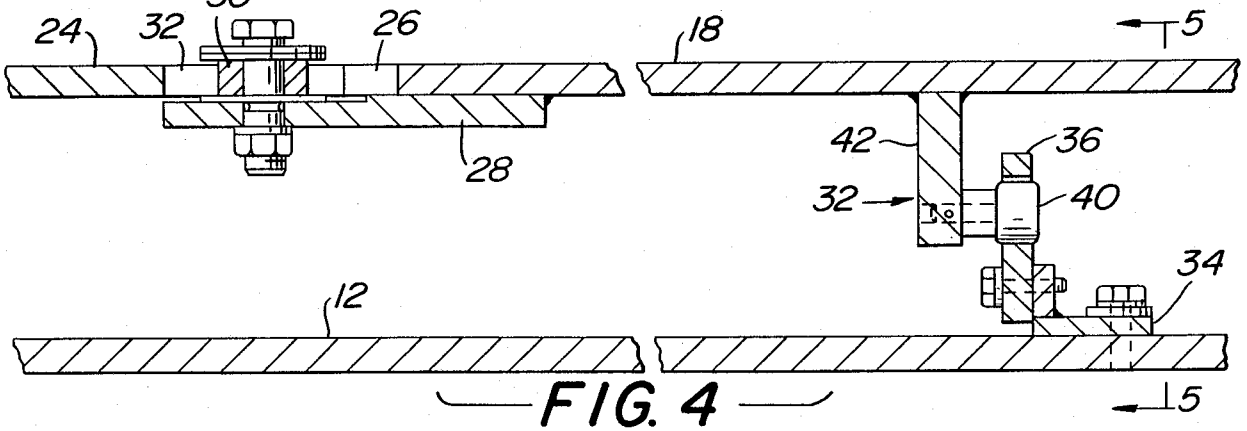
FIG. 4 is a sectional view taken along the line 4—4 in FIG. 3 but on an enlarged scale.
Figure 5:
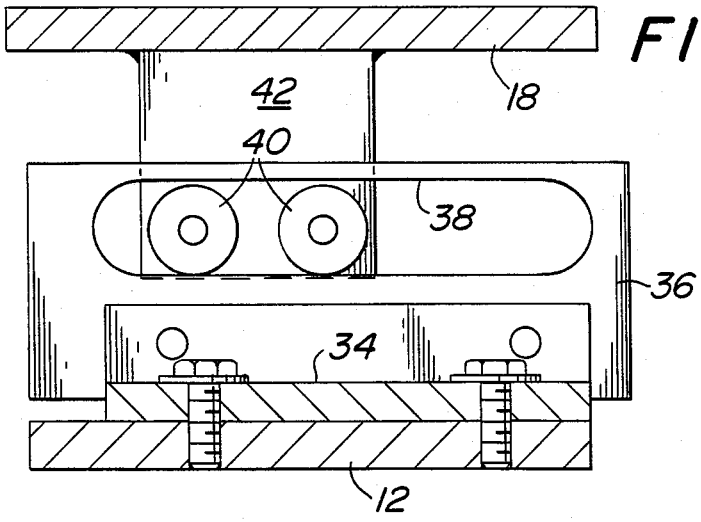
FIG. 5 is a sectional view taken along the line 5—5 in FIG. 4 but on an enlarged scale.

As shown more clearly in FIGS. 4 and 5, there is provided a guide means 32 for maintaining the device 18 in a horizontal disposition. A bracket 34 is fixedly secured to the base plate 12 and supports an upright plate 36. Plate 36 has an elongated slot 38. See FIG. 5. At least one and preferably two rollers 40 are provided in the slot 38 and supported for rotation about a horizontal axis by plate 42. The upper end of plate 42 is fixedly secured to a bottom surface on the device 18. The rollers 40 are longer than the width of the plate 36 and remain in contact with the slot 38 in all pivotable positions of the device 18.

A motor means is provided for moving the device 18 between a first position wherein surface 19 is adapted to contact a drive wheel follower and cause deceleration as shown in FIG. 1 and a second position wherein surface 19 is aligned with surface 23 and neither surface is operative on vehicles passing apparatus 10. The length of movement is quite short. Thus, from the first position of device 18, point X on a flat of surface 19 quickly moves about one inch and then moves slowly to the second position where point X lies on a line extending between the axes of pins 16 and 22.

Figure 6:
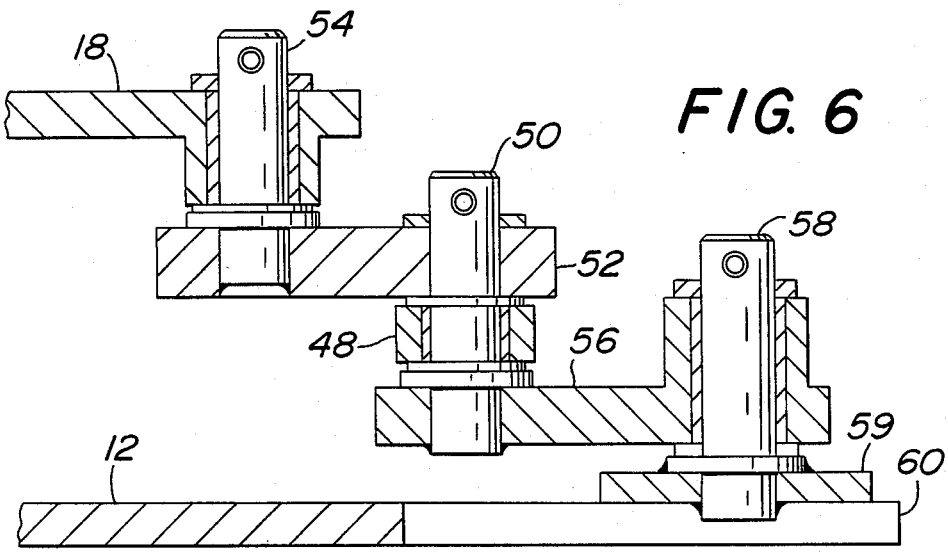
FIG. 6 is a sectional view taken along the line 6—6 in FIG. 3 but on an enlarged scale.

The motor means is preferably an air cylinder 44 having one end pivotably connected to a bracket 46 on the base plate 12. See FIGS. 2 and 3. A piston rod associated with cylinder 44 is connected to a plate 48. A pin 50 extends through plate 48. See FIG. 6. A link 52 is pivotably coupled to pin 50 above the elevation of plate 48. A pin 54 extends through a bushing in device 18 and into a hole in the link 52. The lower end of pin 50 is fixedly secured in a hole in link 56. Link 56 has a bushing through which a pin 58 extends. Pin 58 is fixedly secured to plate 59 which is adjustably secured to a secondary base plate 60 at the same elevation as base plate 12. When the plate 48 is moved from left to right in FIG. 3 due to the introduction of pressurized air into the cylinder 44, device 18 pivots in a clockwise direction in FIGS. 1 and 3 about the pin 16 toward its second position.

Figure 3:
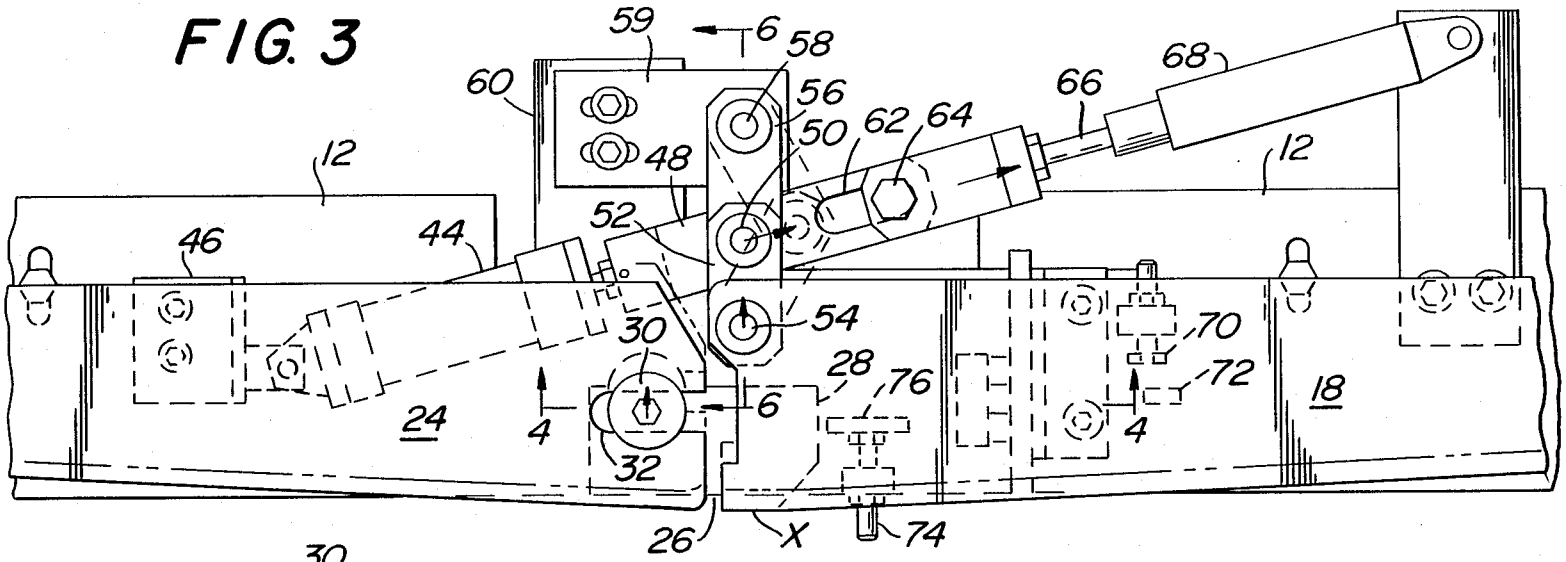
FIG. 3 is an enlarged detailed view of the central portion of the apparatus shown in FIG. 1.

As shown more clearly in FIG. 3, a slot 62 is provided in the plate 48. A pin 64 is disposed within slot 62. Pin 64 is connected to the piston rod 66 of a shock absorber 68. Pin 64 and slot 62 constitute a lost-motion connection between device 18 and the shock absorber 68. The purpose of the lost-motion connection is to control the movement of device 18 so that its initial movement will be rapid and then it will move slowly for the remainder of its movement. In a preferred embodiment, the lost-motion connection facilitates movement of the drive wheel to a 20° position and thereafter it will take five to seven seconds to fully compress the shock absorber and retract the device 18 to its second position.

An adjustable bolt 70 is supported by a bracket on base plate 12. When device 18 reaches its second position, plate 72 contacts bolt 70 to form a limit stop. Plate 72 is attached to device 18 and extends downwardly therefrom. A second adjustable bolt 74 is supported by a bracket on base plate 12. When device 18 is in its first position as shown in FIG. 3, a plate 76 depending from device 18 contacts bolt 74 to form a limit stop.

The cam follower associated with a drive wheel of a driverless vehicle will contact surface 19 and move the drive wheel to a stop position. At that time, the cam follower is in contact with the flat at point X on surface 19. When it is desired to release the vehicle, air is introduced into cylinder 44. The links 52, 56 pivot to the phantom position in FIG. 3, thereby pivoting device 18 clockwise and device 24 counterclockwise in FIG. 3. This action moves surface 23 to an angular position whereby the vehicle drive wheel will be at a 20 degree position.

The vehicle will move away at a rapid pace but its subsequent acceleration is controlled by surface 23. Devices 18 and 24 move toward their second position at a slow rate as soon as plate 48 commences to apply pressure to the shock absorber 68. A control as disclosed increases production speed due to the rapid initial movement of devices 18, 24.

The apparatus 10 has the advantage of being capable of being held in its second position wherein surfaces 19 and 23 are aligned whereby subsequent vehicles will pass by without stopping. If a vehicle is alongside apparatus 10 when devices 18, 24 move to their first position as shown in FIG. 3, it will not interfere with the vehicle. In prior devices such movement could upset the vehicle.

Figure 7:
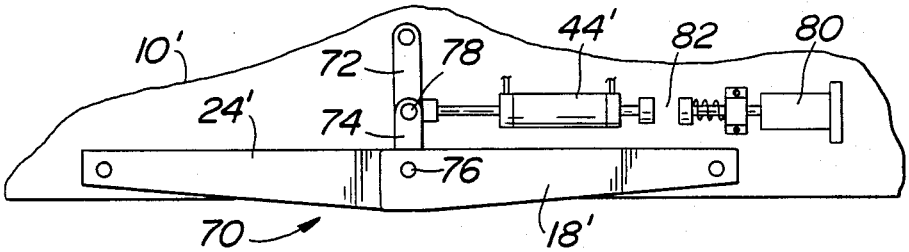
FIG. 7 is a plan view of another embodiment of the present invention.

In FIG. 7 there is illustrated another embodiment of the present invention designated generally as 70. Apparatus 70 is a simplified form of the apparatus 10. Corresponding elements are provided with corresponding primed numerals when comparing apparatus 70 with apparatus 10.

Devices 18' and 24' overlap one another. A pin 76 extends through the overlapped portion of the devices 18' and 24'. Toggle links 72, 74 are pivoted to each other. Link 74 is pivoted to pin 76. Link 72 is pivoted to the base plate 10. The links 72, 74 are slightly over center so as to provide a lock against inadvertent pivotably movement of the devices 18' 24'.

The piston rod of an air cylinder 44' is connected to the pin 78 which couples the links 72 and 74 together. The piston rod associated with cylinder 44 is double ended with its other end being spaced from the plunger of a shock absorber 80 by a gap 82. Gap 82 performs the same function as a lost-motion connection as described above. Device 70 will otherwise perform in the same manner as device 10.

The present invention may be embodied in other specific forms without departing from the spirit or essential attributes thereof and, accordingly, reference should be made to the appended claims, rather than to the foregoing specification, as indicating the scope of the invention.

I claim:

1. Apparatus for controlling the angular position of a drive wheel for a driverless vehicle comprising first and second speed control devices supported for pivotable movement between a first position wherein said first device is adapted to cause deceleration movement of a drive wheel and a second position wherein said second device is adapted to allow acceleration movement of a drive wheel, motor means coupled to said devices for moving said devices between said positions, and means associated with said devices so that said devices move rapidly toward said second position by said motor means for the initial part of their movement and then move slowly for the remainder of their movement.

2. Apparatus in accordance with claim 1 wherein said last mentioned means includes a lost-motion connection between said devices and a shock absorber.

3. Apparatus in accordance with claim 1 wherein said devices includes a pair of plates having adjacent ends pivotably coupled together.

4. Apparatus in accordance with claim 3 wherein the pivotable coupling of said plates includes a member on one plate disposed in a longitudinally extending slot on the other plate.

5. Apparatus in accordance with claim 1 wherein said motor means is coupled to said devices by toggle links.

6. Apparatus in accordance with claim 1 wherein one of said devices is pivoted at one end, guide means intermediate the ends of said one device for maintaining the horizontal disposition of said device.

7. Apparatus in accordance with claim 1 wherein said devices have converging surfaces in their first position, said surfaces being aligned in their second position, and said devices being pivoted about vertical axes.

8. Apparatus for controlling the angular position of a drive wheel for a driverless vehicle comprising a base, first and second speed control devices supported on said base for pivotable movement about a vertical axis between a first position and a second position, motor means coupled to said devices for moving said devices between said positions, means associated with said devices so that said devices move rapidly toward said second position by said motor means for the initial part of their movement and then move slowly for the remainder of their movement, said devices having converging surfaces in their first position, and said surfaces being aligned in their second position.

9. Apparatus in accordance with claim 8 wherein said last mentioned means includes a lost-motion connection between said devices and a shock absorber.

10. Apparatus in accordance with claim 8 wherein said devices include a pair of plates having adjacent ends pivotably coupled together.

11. Apparatus in accordance with claim 10 wherein the pivotable coupling of said plates includes a member on one plate disposed in a longitudinally extending slot on the other plate.

12. Apparatus in accordance with claim 8 wherein said motor means is coupled to said devices by toggle links.

13. Apparatus in accordance with claim 8 wherein said last mentioned means includes a shock absorber spaced from and adapted to be contacted by said motor means.

* * * * *